US007086916B2

(12) United States Patent
Godoy

(10) Patent No.: US 7,086,916 B2
(45) Date of Patent: Aug. 8, 2006

(54) DIFFERENTIATED RIGIDITY SWIMMING FIN WITH HYDRODYNAMICALLY DESIGNED REARWARD SHOE STRAP CONNECTION

(75) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 0 days.

(21) Appl. No.: 10/662,688

(22) Filed: Sep. 12, 2003

(65) Prior Publication Data

US 2004/0053547 A1 Mar. 18, 2004

(30) Foreign Application Priority Data

Sep. 13, 2002 (IT) ..... FI2002A0171

(51) Int. Cl.
*A63B 31/08* (2006.01)

(52) U.S. Cl. ..... 441/64

(58) Field of Classification Search ..... 441/61, 441/64; D21/806
See application file for complete search history.

(56) References Cited

U.S. PATENT DOCUMENTS

| | | | | |
|---|---|---|---|---|
| 4,251,894 A | | 2/1981 | Hollingsworth | |
| 4,887,985 A | | 12/1989 | Garofalo | |
| 5,304,081 A | | 4/1994 | Takizawa | |
| D350,801 S | | 9/1994 | Dagnino | |
| 5,358,439 A | * | 10/1994 | Paolo | 441/64 |
| 5,443,593 A | * | 8/1995 | Garofalo | 441/64 |
| 5,467,508 A | | 11/1995 | Feng | |
| 5,542,865 A | * | 8/1996 | Alvarez De Toledo | 441/64 |
| 5,588,890 A | | 12/1996 | Garofalo | |
| 5,607,334 A | * | 3/1997 | Garofalo | 441/64 |
| D382,322 S | | 8/1997 | Cressi | |
| D421,474 S | | 3/2000 | Godoy | |
| 6,224,443 B1 | * | 5/2001 | Mehrmann et al. | 441/64 |
| 6,364,728 B1 | | 4/2002 | Viale et al. | |
| 6,398,604 B1 | | 6/2002 | Kawashima et al. | |
| 6,568,973 B1 | | 5/2003 | Testa | |
| 6,568,974 B1 | * | 5/2003 | Semeia | 441/64 |
| D490,136 S | | 5/2004 | Godoy | |

FOREIGN PATENT DOCUMENTS

| | | |
|---|---|---|
| EP | 0308988 | 3/1989 |
| EP | 0607568 | 7/1994 |
| EP | 0998962 | 5/2000 |
| EP | 1192974 | 4/2002 |

OTHER PUBLICATIONS

European Search Report, European Patent Application No. 03425594.3, dated Apr. 6, 2004.

* cited by examiner

*Primary Examiner*—Stephen Avila
(74) *Attorney, Agent, or Firm*—Pollack, P.C.; Grant E. Pollack

(57) ABSTRACT

A swimming flipper comprising a blade (1) made of relatively rigid material, a shoe (2) made of relatively yielding material and at least a pair of lateral ribs (3) extending along the edges of the blade. On the blade there are provided at least two longitudinal slots (9) arranged symmetrically with respect to the longitudinal axis of the flipper and two openings (11) extending diagonally from the shoe towards the lateral edges of the blade. The slots and the openings are filled with a relatively yielding material in the form of flattened ribs (12, 13).

11 Claims, 6 Drawing Sheets

DIFFERENTIATED RIGIDITY SWIMMING FIN WITH HYDRODYNAMICALLY DESIGNED REARWARD SHOE STRAP CONNECTION

FIELD OF THE INVENTION

The present invention relates generally to articles for self-propulsion and, more particularly, to foot mounted articles for effecting movement through fluid media or the like.

BACKGROUND OF THE INVENTION

Conventional foot mounted articles for effecting movement through fluid media. e.g., fins for swimming through water, generally take the form of fins which comprise a blade constructed of a relatively rigid material connected at the rear to a shoe made of a relatively yielding material. As set forth in the present description, the term "relatively rigid material" refers to a material such as, for example, polypropylene or the equivalent, while the term "relatively yielding material" in the present description refers to a material such as a thermoplastic polymer based essentially on SEBS elastomers or the equivalent.

Such materials are commonly used in the production of fins for swimmers.

In order to protect against scratches and cuts that may result when the fin comes into contact with reefs, stones and the like, longitudinal edges of the blade are often lined with a yielding material like that of the material comprising the shoe. More particularly, such lining is formed in lateral ribs that generally extend both above and below the plane of the blade so as to improve the propulsive efficacy of the fin without increasing the overall rigidity of the blade. According to a previous invention of the same applicant, these ribs may be constructed of a material having a rigidity intermediate between that of the shoe and the blade. In this manner, the designer has much more freedom of choice in the hydrodynamic and mechanical characteristics of the fin, which are often in contrast with each other.

Generally speaking, the efficiency of a fin depends on the above-mentioned characteristics. Accordingly, designers and manufacturers of fins concentrate on them, though not without considering that any modification to the structure of the fin that is intended to improve these characteristics must also be aesthetically pleasing as well as original.

More particularly, it has been found that the efficiency of a conventional swimming fin has a first limitation in that the rigid blade generally bends only in a plane substantially at right angles to the plane of the undeformed blade, its transverse sections being maintained substantially constant.

Second, it has been found, from a hydrodynamic point of view, that the fin's efficiency is to some extent negatively affected by the presence of buckles on the closing strap of the shoe. This is because the buckles typically project sideways and are thus an obstacle to the free flow of water along the fin.

OBJECTS AND SUMMARY OF THE INVENTION

An object of the present invention is to provide a fin for swimmers having improved propulsion efficiency as compared to conventional fins.

These objects and advantages are attained by improving the structure of the fin from both mechanical and hydrodynamic points of view. In particular, elastic hinges extending in both the longitudinal and diagonal direction are also provided on the blade of the fin to enable deformation of transverse sections of the fin. Moreover, along side portions of the shoe, sideways projecting fairings are utilized with a thickness at least equal to that of the buckle, so that fluid may flow above the buckle and not be negatively affected by its presence. Furthermore, with a view toward limiting any encumbrance caused by the buckle to the greatest possible extent, the blade has an outwardly convex hood at the connection point shaped in such a manner as to contain a connection element with which the buckle is provided to enable it to engage an appropriately shaped opening on the bottom of the hood.

BRIEF DESCRIPTION OF THE DRAWINGS

Other characteristics and advantages of the present invention will become apparent from the description set forth below, which is exemplary and is not to be considered limiting in any way, such description making reference to the attached drawings in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
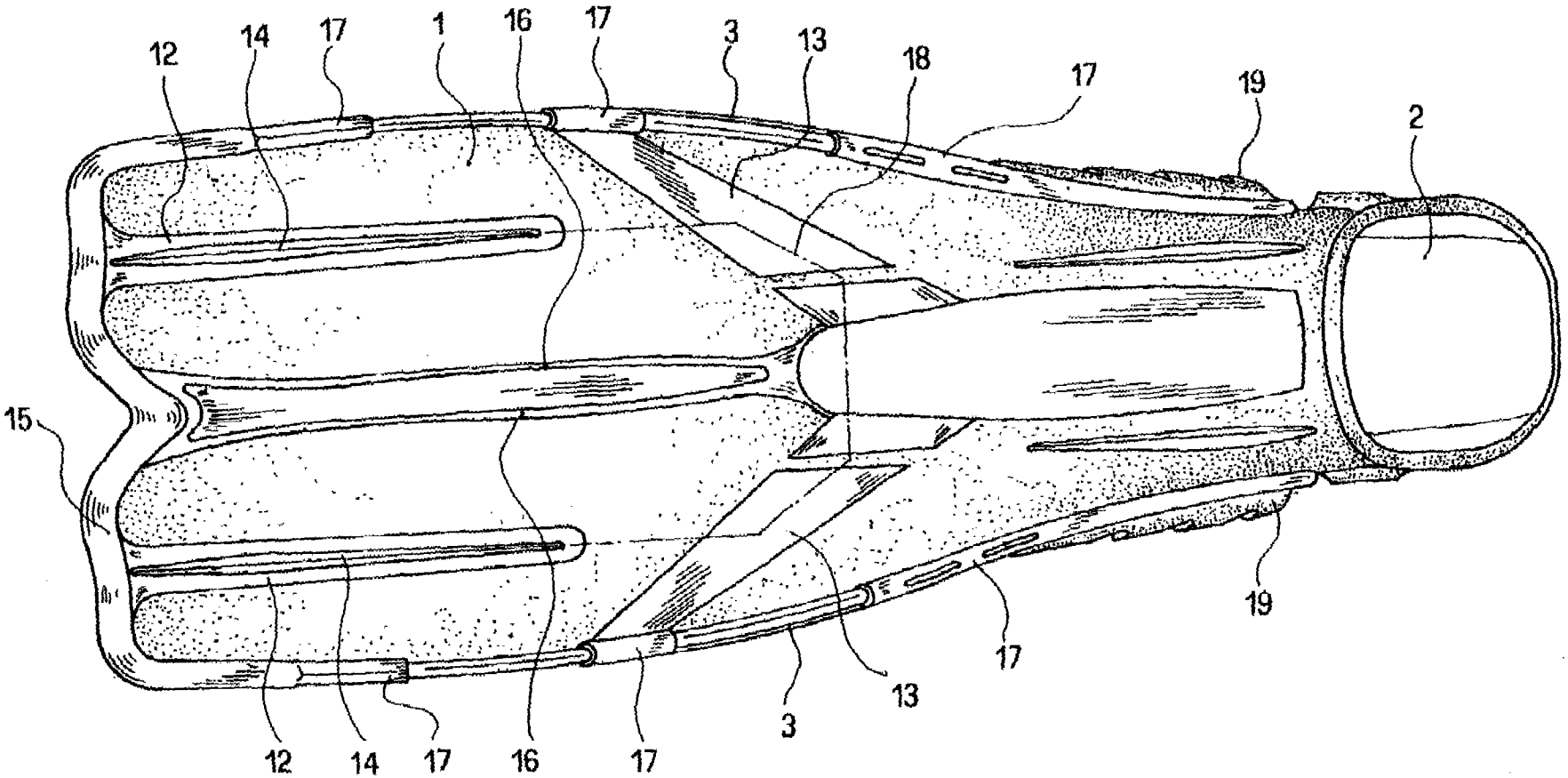
FIG. 1 is a plan view of a fin for swimmers, according to one aspect of the present invention.
Figure 2:
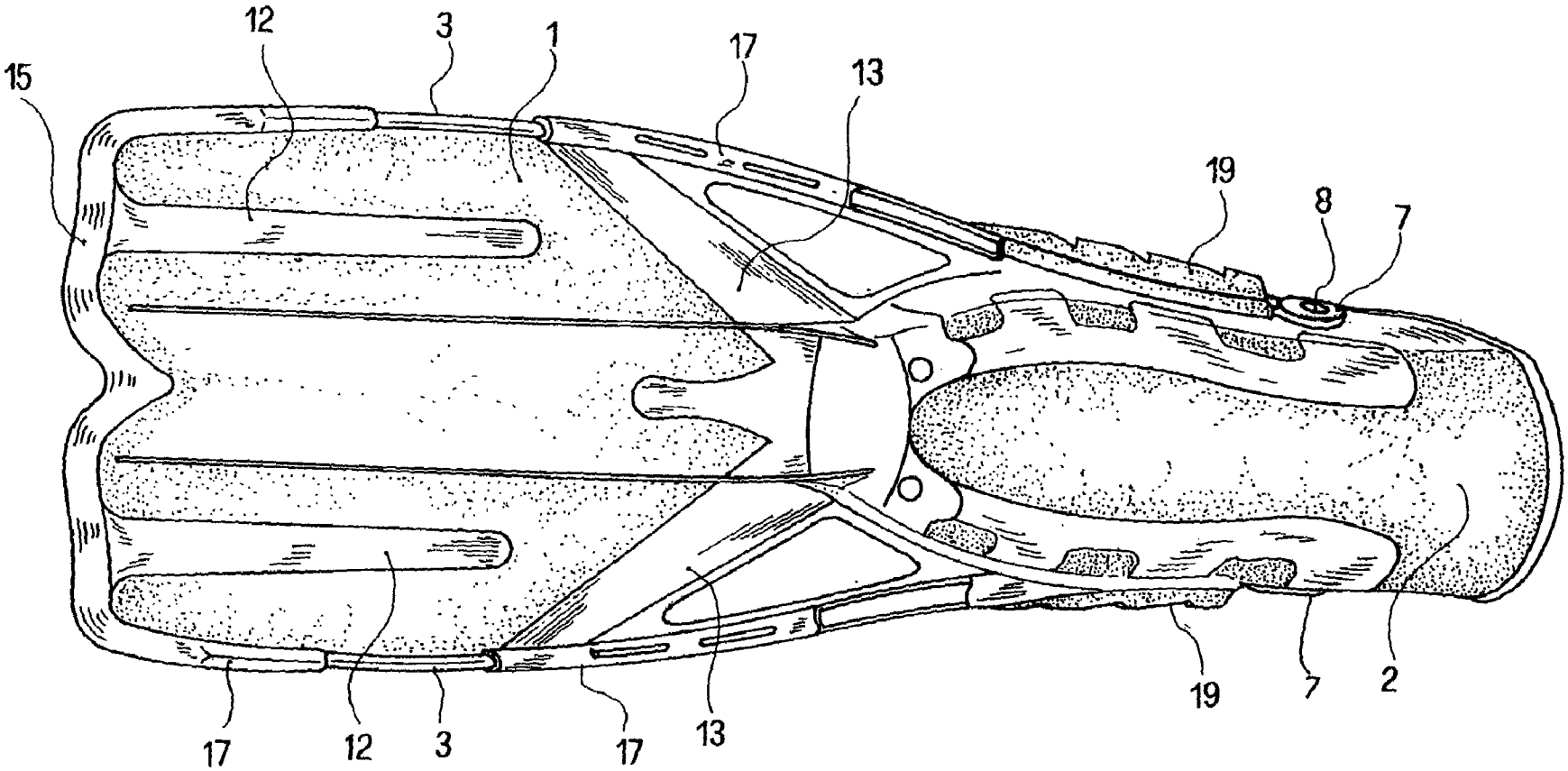
FIG. 2 is a partially sideways, inclined bottom plan view of the fin shown in FIG. 1.
Figure 3:
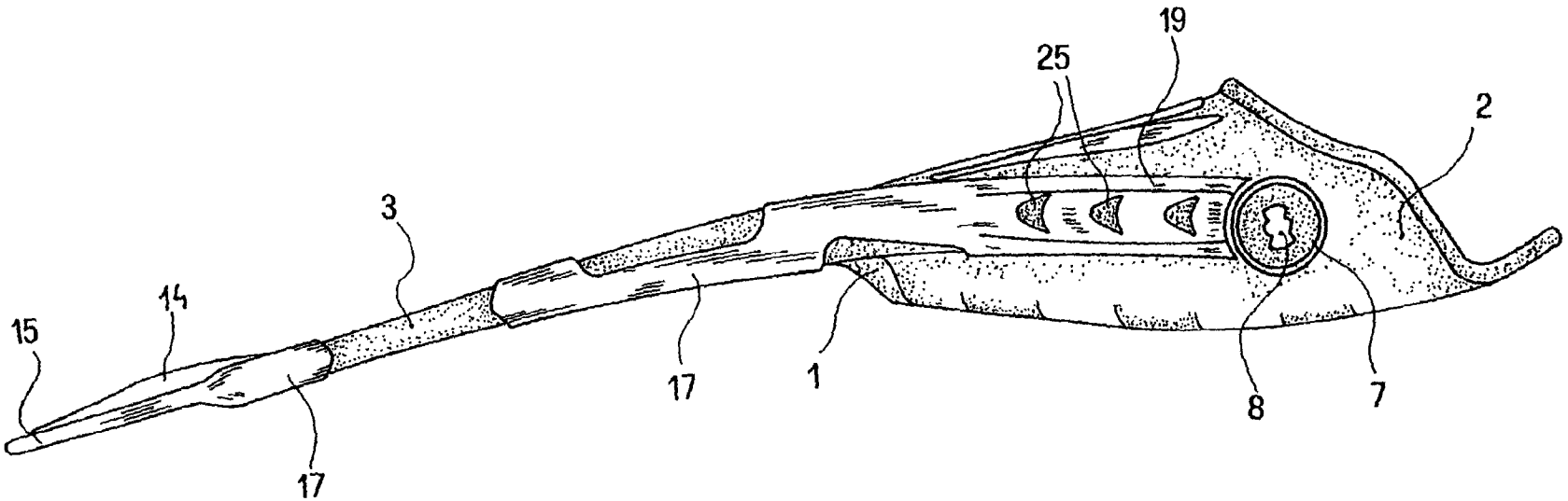
FIG. 3 is a side elevational view of the fin shown in FIG. 1.
Figure 4:
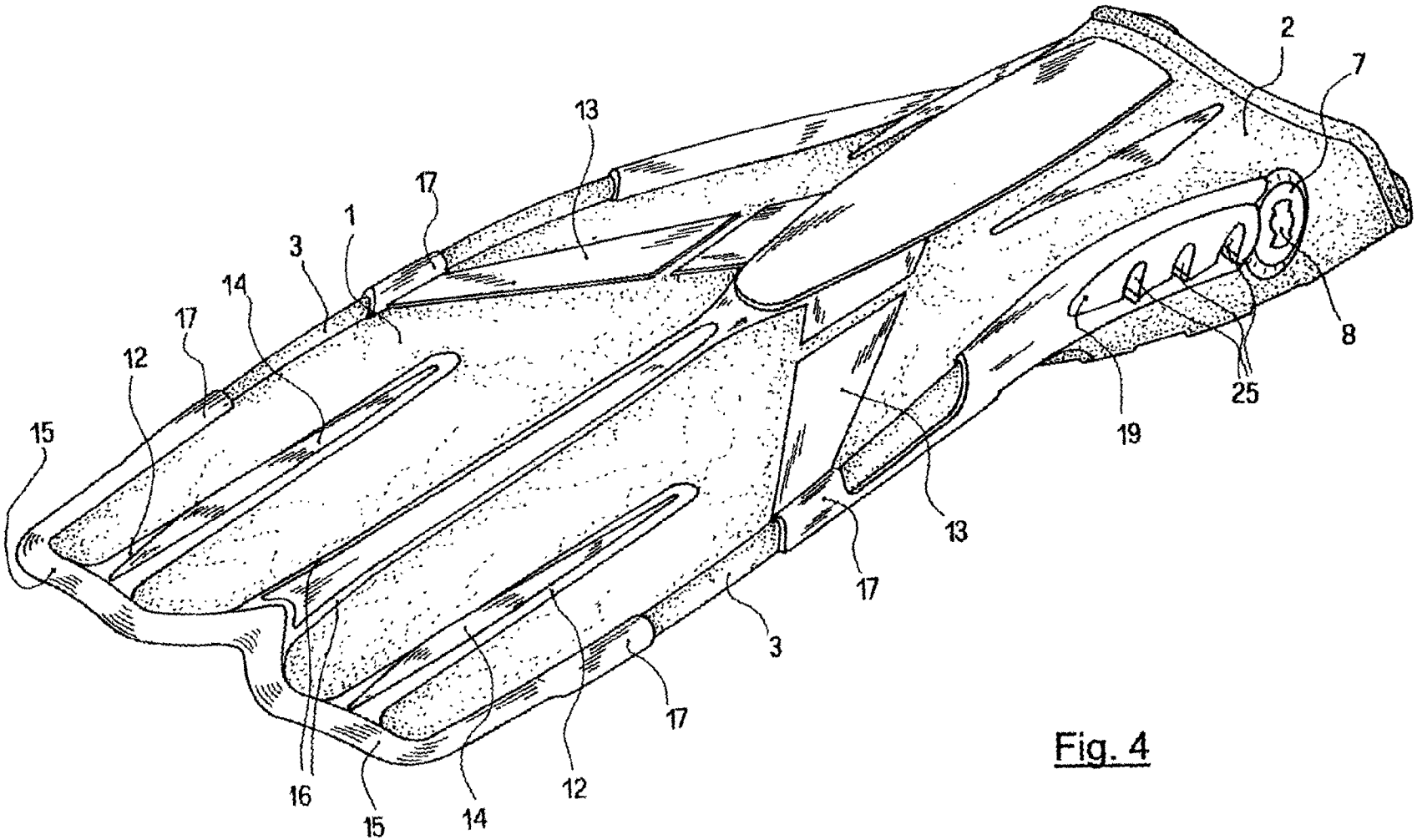
FIG. 4 is a perspective view of the fin shown in FIG. 1.

Referring now to the drawings and, more particularly, to FIGS. 1–4, there is shown generally a specific, illustrative differentiated rigidity swimming fin with hydronamically designed rearward shoe strap connection. According to one aspect of the present invention, the fin comprises a paddle or blade 1 constructed of a relatively rigid material, a shoe 2 made of a relatively yielding material, and a plurality of generally lateral ribs 3, preferably two, extending along the edges of blade 1, both above and below the plane of the blade, and constructed of a material having rigidity characteristics intermediate between those of the blade and the shoe. Preferably, the fin is produced in three successive molding stages: First, the blade is molded, the resulting product being shown in FIG. 5; second, the lateral ribs are molded, so as to obtain the product shown in FIG. 6; and three, the shoe and the remaining parts of the flipper, made of a relatively yielding material, are molded onto the blade.

Figure 5:
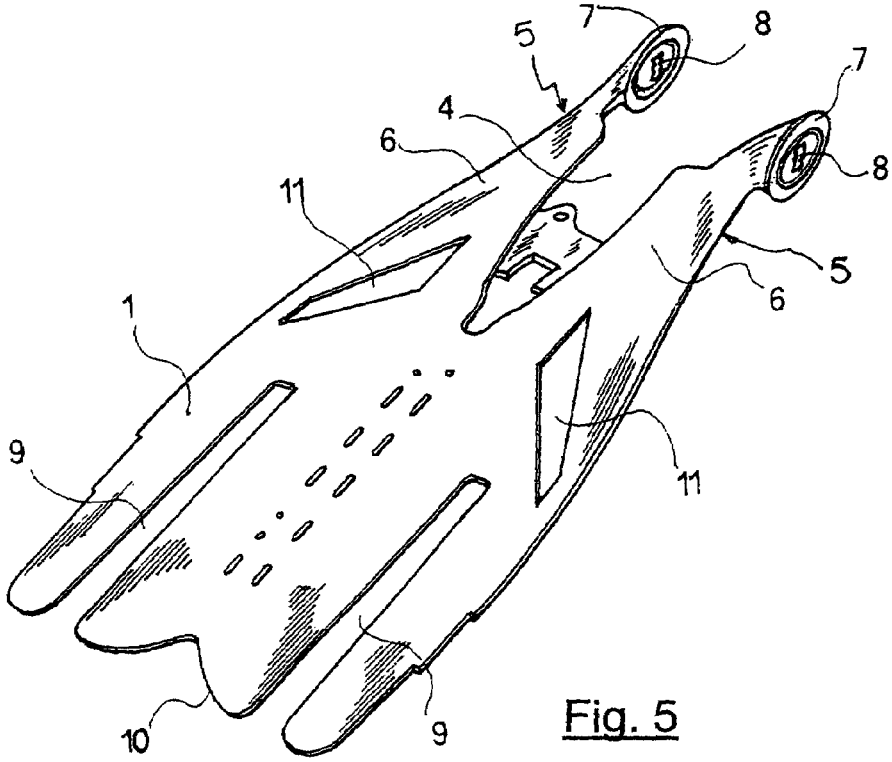
FIG. 5 is a perspective view of a blade portion of the fin shown in FIG. 1.
Figure 6:
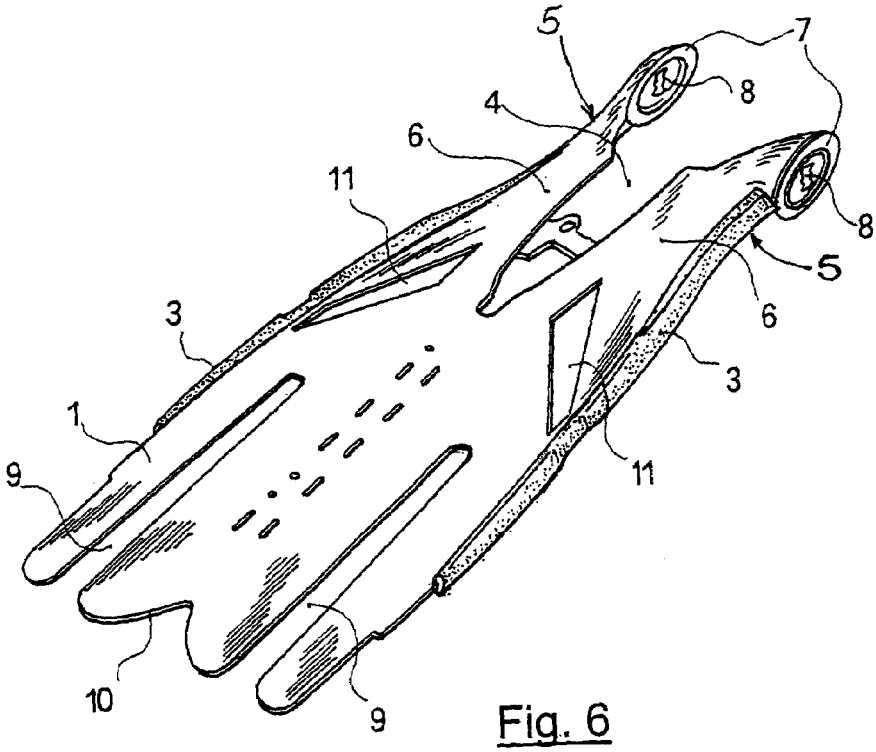
FIG. 6 is a perspective view of the blade of FIG. 5 with lateral ribs along the blade edges.

As shown in FIGS. 5 and 6, the blade extends rearwardly, generally in the form of two relatively identical arms 5 delimiting a central opening 4 that constitutes substantially the seating of shoe 2. The seating is preferably molded below the plane of the blade. Arms 5 desirably extend with an arcuate profile to form flanks 6 containing the shoe and terminating with respective rigid hoods. The hoods are preferably convex towards the outside and have respective butterfly-shaped openings 8 at their center.

According to one embodiment, lateral ribs 3 are molded along a portion of the lateral edges of the blade and extend along sides 6 through to the root or base of their respective hoods.

As shown in FIG. 5, blade 1 includes a pair of longitudinal slots 9 substantially parallel to the longitudinal axis of the fin and extending from just beyond the middle of the blade through to its free edge 10. The blade is also provided with two diagonal openings 11 formed at the sides of a forward end of opening 4 and diverging from the opening toward the lateral edges of the blade.

Shoe 2 is desirably molded onto blade 1 in the third stage of the molding process, which simultaneously fills the two slots 9 and two openings 11 preferably with the same material, thereby producing generally flattened ribs 12 and 13 that operate jointly as elastic hinges.

The thickness of flattened ribs 12 and 13, which fill slots 9 and openings 11, is preferably greater than the thickness of rigid blade 1. In particular, flattened ribs 12 and 13 are made of a material that is generally less rigid than the blade material. Their inferior mechanical characteristics are, therefore, at least partially compensated for using a greater thickness. Advantageously, flattened ribs 12 and 13, arranged in slots 9, may also be provided with relatively thin longitudinal fins 14 for directing the flow.

Along a free edge 10 of the blade, a relatively wide flattened curb 15 is preferably provided that closes longitudinal slots 9 of the blade. According to one aspect of the present invention, the curb is made of the same material as shoe 2 and, during the molding stage, is produced desirably using two thin feeder channels 16 that do not interrupt the continuity of the blade and are situated in its central part As shown in FIG. 1, the channels are filled with the relatively yielding material.

The material of the shoe, namely, a partial lining 17, advantageously covers those portions of lateral ribs 3 that have the greatest likelihood of damage from contact with hard materials such as stones, reefs and the like. Toward free end 10 of the blade, the partial lining 17 preferably combines with or joins curb 15.

Flattened ribs 12 and 13, as areas of reduced rigidity on the blade, function as hinges. In particular, when subjected to the thrust of a swimmer's foot, the ribs enable the blade to assume substantially a concave form with substantially plane walls. Specifically, under these conditions, the blade assumes a trapezoidal-like profile in the transverse direction where its inclined sides are formed by portions of the blade between the lateral edges and fins 14, whereas its shorter base is formed by the central portion of the blade between fins 14 and extending as far as the flattened diagonal ribs 13 with a profile approximately equal to the one indicated by the broken line in FIG. 1 and the reference number 18.

The elastic hinges provided on the blade, constituted by ribs 12 and 13 formed in slots 9 and openings 11, enable the blade to assume a concave shape both during the power stroke and during the return stroke, when the blade encounters lesser resistance, thereby improving the fin's overall performance.

It is desirable that the lining of relatively yielding material 17 extend along the flanks 6 of blade 1, from the lateral edges of the blade, through to the vicinity of hood 7. The cross section of lining 17 becomes considerably thicker along these flanks so as to generate respective fairings 19 that convey the flow of water to above a pair of buckles 20 arranged at the two ends of a strap 21 that closes the shoe. Advantageously and preferably, buckle 20 is of the so-called "fast" type, already used extensively for this application, and comprises a sheath 22 and a shutter 23, generally of three-pronged shape.

Figure 7:
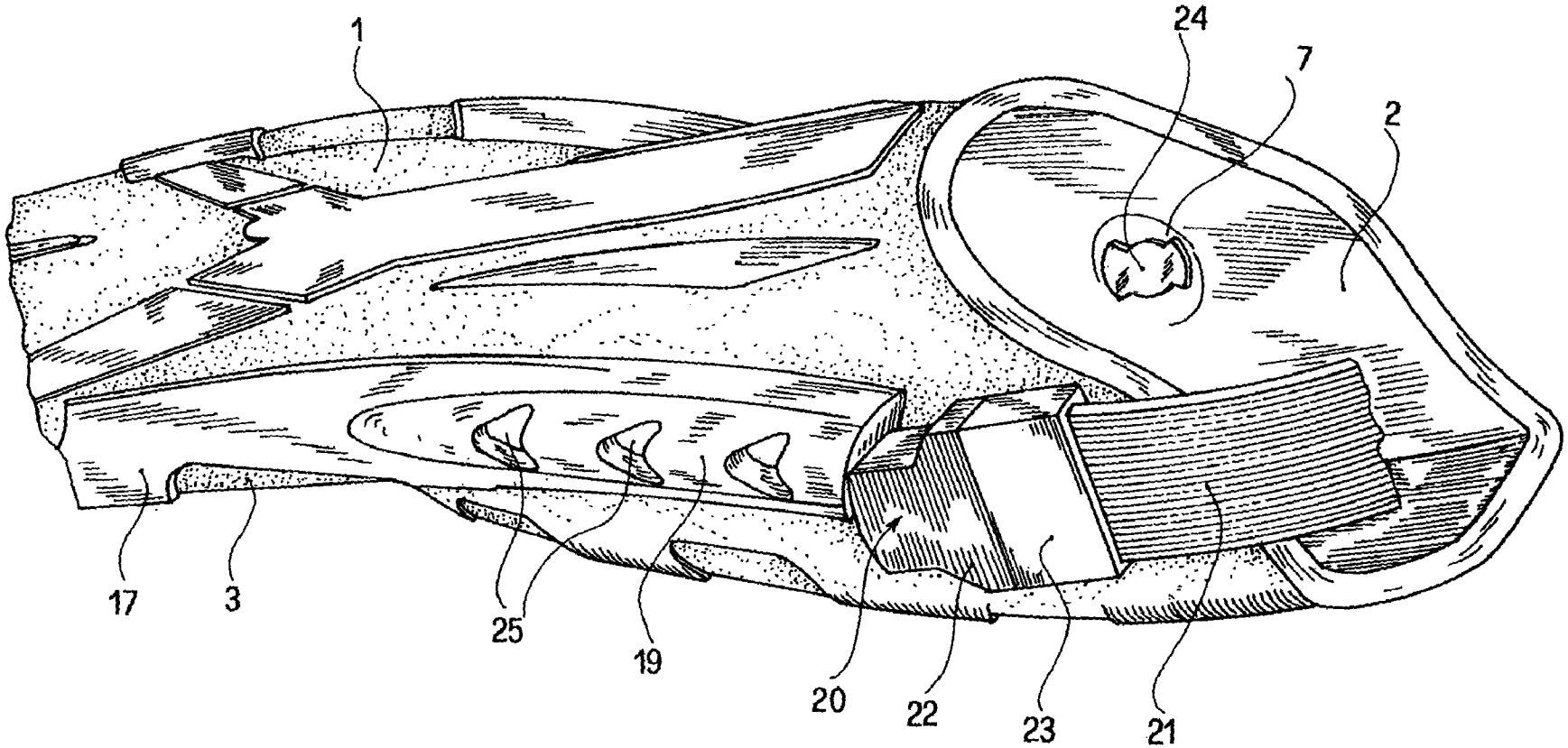
FIG. 7 is an enlarged perspective view of a rear portion of the fin shown in FIG. 1.

According to another aspect of the present invention, sheath 22 is provided on its interior face with a head 24 having a shape generally equal to that of opening 8 formed on hood 7 of flanks 6. As shown in FIG. 7, head 24 of the buckle is engaged with the seating which comprises the hood. This connection is accomplished by moving the sheath of the buckle into a position that is rotated 90° relative to its working position, inserting head 24 into opening 8, and rotating the sheath 90° in such a way that the head bears against the walls delimiting the respective opening. It should be noted that, given the exemplary solution illustrated, the buckle can preferably tolerate an angular excursion of about ±45° relative to its normal working position, i.e., the one shown in FIG. 7. This makes it possible to vary the inclination of the strap by a similar amount according to the particular needs of the swimmer, and thereby improve the comfort of the fin. Also notable is that openings 25 may be provided on fairings 19, such openings having a predominantly aesthetic function.

Various modifications and alterations to the invention may be appreciated based on a review of this disclosure. These changes and additions are intended to be within the scope and spirit of the invention as defined by the following claims.

What is claimed is:

1. A fin for self-propulsion in a fluid, the fin comprising a blade constructed of a relatively rigid material, a shoe made of a first relatively yielding material, and a plurality of generally lateral ribs extending along edge portions of the blade, the blade having a plurality of longitudinal slots arranged symmetrically with respect to the longitudinal axis of the fin and a plurality of openings, extending diagonally from the shoe toward lateral edges of the blade, the slots and the openings being filled with a second relatively yielding material in the form of flattened ribs, the lateral ribs being both above and below the plane of the blade so as to enhance the spoon effect of the fin without increasing the overall rigidity of the blade.

2. The fin set forth in claim 1, wherein the lateral ribs are at least partially lined with the relatively yielding material of the shoe.

3. The fin set forth in claim 2, wherein the lateral ribs are constructed of a material having a rigidity intermediate between that of the blade and the shoe.

4. The fin set forth in claim 3, wherein the lining of the lateral ribs enlarges rearwardly along flank portions of the shoe so as to form respective sideway projecting fairings.

5. A fin for self-propulsion in a fluid, the fin comprising a blade constructed of a relatively rigid material, a shoe made of a first relatively yielding material, and a plurality of generally lateral ribs extending along edge portions of the blade, the blade having a plurality of longitudinal slots arranged symmetrically with respect to the longitudinal axis of the fin and a plurality of openings, extending diagonally from the shoe toward lateral edges of the blade, the slots and the openings being filled with a second relatively yielding material in the form of flattened ribs, wherein the lateral ribs are at least partially lined with the relatively yielding material of the shoe and are constructed of a material having a rigidity intermediate between that of the blade and the shoe, the lining of the lateral ribs enlarging rearwardly along flank portions of the shoe so as to form respective sideway projecting fairings, the blade extending rearwardly by two arms forming containment flanks for the shoe and terminating with a hood to form a seating in which a respective buckle of a closure strap can engage.

6. The fin set forth in claim 5, wherein the lining of the ribs forming the lateral fairings has a thickness of not less than the thickness of the buckles applied to the ends of the arms.

7. The fin set forth in claim 5, wherein the thickness of the flattened ribs is greater than the thickness of the blade.

8. The fin set forth in claim 2, wherein a free edge of the blade is lined with a curb that closes the slots and becomes joined to the lining of the lateral ribs.

9. A fin for self-propulsion in a fluid, the fin comprising a blade constructed of a relatively rigid material, a shoe made of a first relatively yielding material, and a plurality of generally lateral ribs extending along lateral edge portions of the blade, the lateral ribs having a lining extending therefrom, the lining being constructed of a second relatively yielding material that enlarges at flank portions of the shoe, such that a sideways projecting fairing is generated, the blade comprising a plurality of arms that extend backwardly therefrom to form containment flanks for the shoe and terminate with respective seatings for buckles of a closure strap, the fairings projecting sideways to a thickness of not less than that of the respective buckle, and the lateral ribs being both above and below the plane of the blade so as to enhance the spoon effect of the fin without increasing the overall rigidity of the blade.

10. A fin for self-propulsion in a fluid, the fin comprising a blade constructed of a relatively rigid material, a shoe made of a first relatively yielding material, and a plurality of generally lateral ribs extending along lateral edge portions of the blade, the lateral ribs having a lining extending therefrom, the lining being constructed of a second relatively yielding material that enlarges at flank portions of the shoe, such that a sideways projecting fairing is generated, the blade comprising a plurality of arms that extend backwardly therefrom to form containment flanks for the shoe and terminate with respective seatings for buckles of a closure strap, the fairings projecting sideways to a thickness of not less than that of the respective buckle, wherein the buckle comprises a connection head that extends from its inner face, the seating for the buckle comprising a hood that is generally convex toward the outside and has a shaped central opening with which the correspondingly shaped head of the buckle engages, so that the connection is subsequently made by rotating the head through 90° within the opening.

11. A fin for self-propulsion in a fluid, the fin comprising a blade constructed of a relatively rigid material, a shoe made of a first relatively yielding material, and a plurality of generally lateral ribs extending along lateral edge portions of the blade, the lateral ribs having a lining extending therefrom, the lining being constructed of a second relatively yielding material that enlarges at flank portions of the shoe, such that a sideways projecting fairing is generated, the blade comprising a plurality of arms that extend backwardly therefrom to form containment flanks for the shoe and terminate with respective seatings for buckles of a closure strap, the fairings projecting sideways to a thickness of not less than that of the respective buckle, wherein the buckle comprises a connection head that extends from its inner face, the seating for the buckle comprising a hood that is generally convex toward the outside and has a shaped central opening with which the correspondingly shaped head of the buckle engages, so that the connection is subsequently made by rotating the head through 90° within the opening, the connection head being rotatably engaged in the opening of the hood.

* * * * *